US011104487B2

(12) United States Patent
Septien Rojas et al.

(10) Patent No.: US 11,104,487 B2
(45) Date of Patent: Aug. 31, 2021

(54) AUDIBLE CUT AND CRUSH ZIPPER

(71) Applicants: Jose Manuel Septien Rojas, Scarborough (GB); Gary Allport, Scarborough (GB)

(72) Inventors: Jose Manuel Septien Rojas, Scarborough (GB); Gary Allport, Scarborough (GB)

(73) Assignee: ILLINOIS TOOL WORKS INC., Glenview, IL (US)

( * ) Notice: Subject to any disclaimer, the term of this patent is extended or adjusted under 35 U.S.C. 154(b) by 325 days.

(21) Appl. No.: 14/045,887

(22) Filed: Oct. 4, 2013

(65) Prior Publication Data

US 2014/0143988 A1 May 29, 2014

Related U.S. Application Data

(60) Provisional application No. 61/729,708, filed on Nov. 26, 2012.

(51) Int. Cl.
*B65D 33/25* (2006.01)

(52) U.S. Cl.
CPC ..... *B65D 33/2508* (2013.01); *B65D 33/255* (2013.01); *B65D 33/2558* (2013.01); *Y10T 24/2538* (2015.01)

(58) Field of Classification Search
CPC ..... B65D 33/255; B65D 33/2541; B65D 33/2508; B65D 33/2558; A44B 19/16; Y10T 24/2538
USPC ..... 24/402, 585.12, 586.11; 383/63
See application file for complete search history.

(56) References Cited

U.S. PATENT DOCUMENTS 3,338,284 A * 8/1967 Ausnit ..... B65D 33/2541 24/585.12
5,070,584 A * 12/1991 Dais ..... B26F 1/12 24/400
5,138,750 A * 8/1992 Gundlach ..... B65D 33/255 24/403
5,140,727 A * 8/1992 Dais ..... B65D 33/255 24/400
5,398,387 A * 3/1995 Torigoe ..... A44B 18/0053 24/452
5,722,128 A * 3/1998 Toney ..... B65D 33/2591 24/399
6,217,215 B1 * 4/2001 Tomic ..... B65D 33/2541 24/DIG. 50
6,594,872 B2 * 7/2003 Cisek ..... B29D 5/10 24/389
7,270,479 B2 * 9/2007 Nelson ..... B65B 31/00 383/103
7,784,160 B2 * 8/2010 Dais ..... B65D 33/2508 24/585.12
7,857,515 B2 * 12/2010 Dais ..... B65D 33/25 24/585.12
7,886,412 B2 * 2/2011 Dais ..... B65D 81/2023 24/399
2004/0013323 A1 * 1/2004 Withers ..... B65D 33/007 383/63

(Continued)

*Primary Examiner* — David M Upchurch
(74) *Attorney, Agent, or Firm* — McCarter & English, LLP

(57) ABSTRACT

A zipper for a reclosable package or bag, wherein the female profile has been crushed at first periodical intervals and the male profile has been cut at second periodic intervals. This provides audible and tactile feedback characteristics to the zipper.

25 Claims, 3 Drawing Sheets

(56) References Cited

U.S. PATENT DOCUMENTS

| | | | | |
|---|---|---|---|---|
| 2006/0008184 | A1* | 1/2006 | Borchardt | B65D 33/2541 383/63 |
| 2009/0304309 | A1* | 12/2009 | Hayes | A44B 18/0053 383/63 |
| 2010/0040310 | A1* | 2/2010 | Turvey | B65D 33/2508 383/103 |
| 2012/0027322 | A1* | 2/2012 | Ackerman | A44B 19/16 383/64 |
| 2012/0213454 | A1* | 8/2012 | Price | B65D 33/255 383/63 |
| 2012/0301056 | A1* | 11/2012 | Anzini | B29D 5/10 383/61.2 |
| 2013/0207311 | A1* | 8/2013 | Plourde | B29D 5/10 264/299 |

* cited by examiner

AUDIBLE CUT AND CRUSH ZIPPER

BACKGROUND OF THE DISCLOSURE

The present application claims priority under 35 U.S.C. 119(e) of provisional application Ser. No. 61/729,708, which was filed on Nov. 26, 2012, the contents of which are hereby incorporated by reference in their entirety.

Field of the Disclosure

The present disclosure relates to a zipper for a reclosable package or bag, wherein the female profile has been crushed at first intervals and the male profile has been cut at second intervals in order to generate increased audible and/or tactile feedback during operation of the zipper.

Description of the Prior Art

In the prior art, audible zippers for reclosable packages or bags are known. Audible zippers provide an audible and tactile feedback to the user when opening and/or closing. This results in a more reliable and trustworthy operation of the zipper by the user.

While many of these audible zippers are well-adapted for their intended purposes, further improvements are sought in providing the audible and/or tactile feedback, controlling the opening force and preventing sliding of the interlocked profiles with respect to each other. Additionally, further improvements are sought with respect to simplification of manufacturing and reduction of manufacturing costs.

OBJECTS AND SUMMARY OF THE DISCLOSURE

It is therefore an object of the present disclosure to provide improvements in audible zippers for reclosable packages or bags.

This and other objects are attained by providing a zipper for a reclosable package or bag wherein the female profile has been crushed at first periodic intervals and the male profile has been cut at second periodic intervals, wherein the first periodic intervals may be the same or different from the second periodic intervals. Typically, it is expected that that cuts in the male profile will provide for increased audible feedback when the zipper is being opened while the crushed areas in the female profile will provide for increased tactile feedback when the zipper is being closed.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 1:
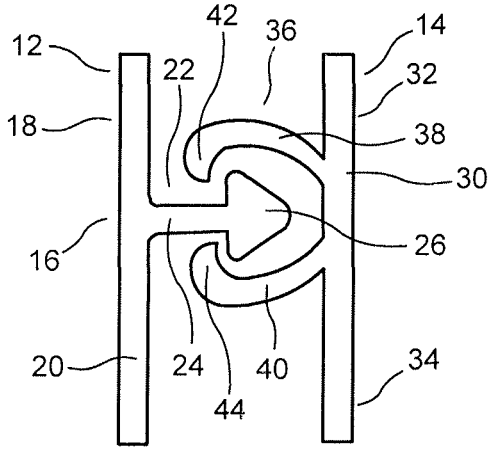
FIG. 1 is a view of the interlocked male and female profiles along a plane where neither of the profiles are cut or crushed.

Referring now to the drawings in detail wherein like numerals indicate like elements throughout the several views, one sees that FIG. 1 is a typical view of zipper (or reclosure) 10, along a plane which includes neither the crushed or cut portions which will be described hereinafter. Zipper 10, which is typically made from a polymeric material, includes a first profile 12 and a second profile 14, as is typically used in connection with a reclosable package, bag or similar container. Moreover, the terms "first profile" and "second profile" may refer to sides of the zipper or reclosure that the respective interlocking elements are on, rather than necessarily separate or independent interlocking elements. First profile 12 includes a first base 16 which forms first upper flange 18 and first lower flange 20. First interlocking element 22, illustrated as a male element, extends from a central portion of first base 16. First interlocking element 22 includes a post element 24 which terminates in an arrowhead-shaped element 26. Second profiles includes a second base 30 which forms second upper flange 32 and second lower flange 34. Second interlocking element 36, illustrated as a female element, extends from a central portion of second base 30. Second interlocking element 36 includes first and second interlocking arms 38, 40 which terminate at their respective distal ends in first and second hooks 42, 44, which, in the interlocked configuration, engage the arrowhead-shaped element 26. These zipper profiles 12, 14 are meant to be illustrative of a typical embodiment. However, it is envisioned that this disclosure is applicable to a wide range of zipper types, such as, but not limited to, multiple male elements on each profile (with some elements crushed and others cut), J-hooks, and many other embodiments.

Figure 2:
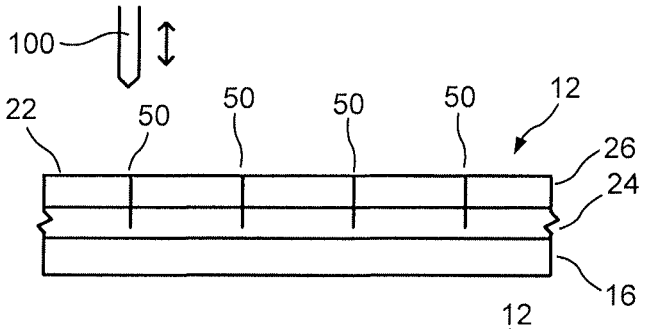
FIG. 2 is a side plan view of the male profile of the present disclosure.
Figure 3:
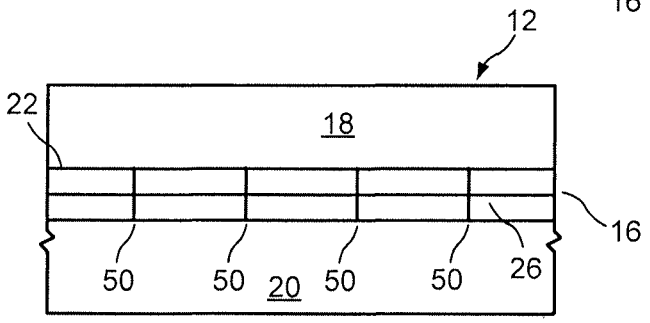
FIG. 3 is a top plan view of the male profile of the present disclosure.
Figure 6:
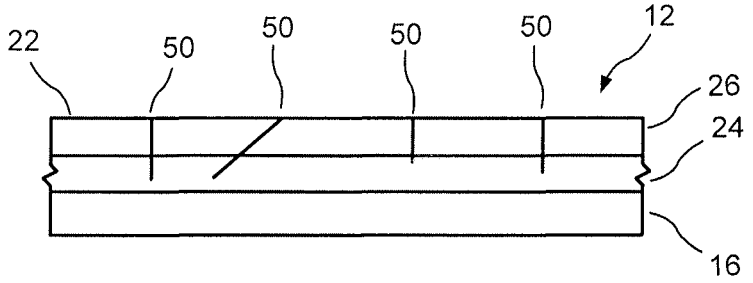
FIG. 6 is a side plan view of the male profile of the present disclosure, illustrating an embodiment with non-periodic spacing and non-uniform depths of the cuts, as well as an orientation that is not perpendicular with the base of the profile.
Figure 7:
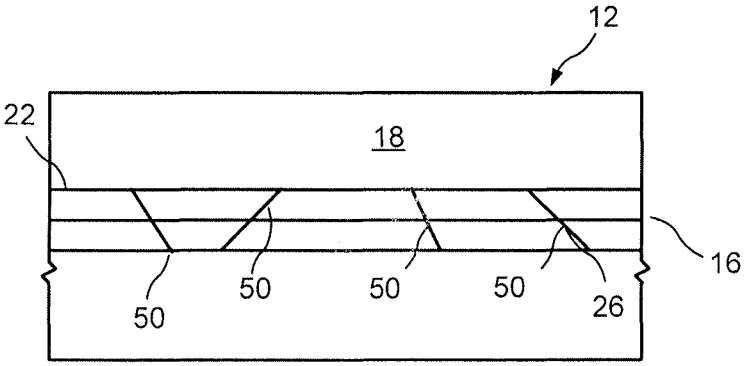
FIG. 7 is a top plan view of the male profile of the present disclosure, illustrating cuts which are not perpendicular with the longitudinal axis of the profile.

As shown in FIGS. 2 and 3, the first (or male) interlocking element 22 includes periodic cuts 50 with extend partially through the interlocking element 22. This partial extension through the interlocking element 22 permits the interlocking element 22 to maintain its single integral structure. The periodic cuts 50 may be formed by blade 100 which is heated to the extent to soften the polymeric material of the zipper 10. These cuts 50 are illustrated as being perpendicular to the first base 16 (and the longitudinal axis of the profile 12) and extending at a uniform depth along the substantial height of the first interlocking element 22. However, as shown in FIGS. 6 and 7, it is envisioned that cuts 50 may be implemented at different and/or non-uniform depths, different and/or non-uniform angles (with respect to either the base or the longitudinal axis of the profile 12) by way of slanting the blade 100 and different and/or non-uniform spacings. Cuts 50 may be spaced apart from each other in a manner which is not periodic. Typically, cuts 50 will provide audible feedback (i.e, generated noise) when the zipper 10 is being opened or the first and second profiles 12, 14 are being separated from each other (and may modify the opening force of the zipper 10), while crushing the profile will enhance the tactile feedback when closing the zipper 10, as when the first and second profiles 12, 14 are being interlocked or joined to each other.

Figure 4:
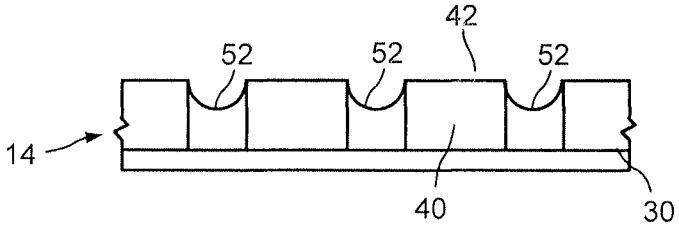
FIG. 4 is a side plan view of the female profile of the present disclosure.
Figure 5:
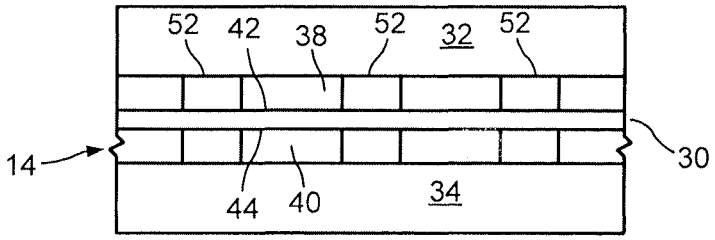
FIG. 5 is a top plan view of the female profile of the present disclosure.
Figure 8:
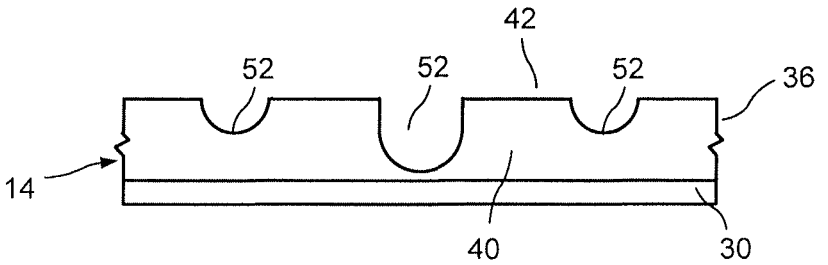
FIG. 8 is a side plan view of the female profile of the present disclosure, illustrating crushed areas which are of non-uniform depth, longitudinal length and spacing.
Figure 9:
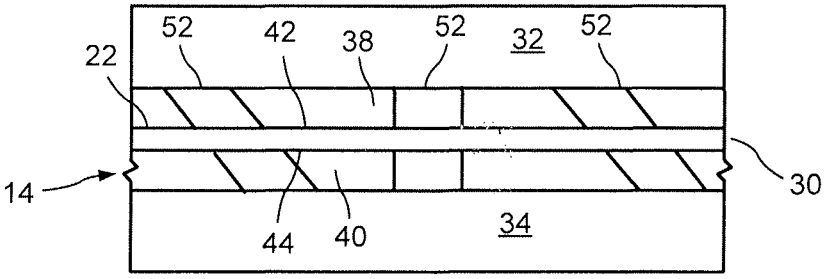
FIG. 9 is a top plan view of the female profile of the present disclosure, illustrating crushed areas which are not perpendicular to the longitudinal axis of the profile.

As shown in FIGS. 4 and 5, the second (or female) interlocking element 36 includes periodic crushed areas 52 in the first and second interlocking arms 38, 40. These crushed areas 52 are illustrated as being of uniform depth and longitudinal length, periodic spacing, and perpendicular to the longitudinal axis of the second interlocking element 36. However, as illustrated in FIGS. 8 and 9, it is envisioned that crushed areas 52 may be implemented at various and/or non-uniform depths, various and/or non-uniform longitudinal lengths, various and/or non-uniform angles with respect to the longitudinal axis of the profile 14 and various and/or non-uniform spacings. Crushed areas 52 may be spaced apart from each other in a manner which is not periodic. Moreover, when cuts 50 are periodically spaced at first intervals on first profile 12 and crushed areas 52 are periodically spaced at second intervals on second profile 14, the first and second intervals may be different from each other or may be the same. Crushed areas 52 will provide increased tactile feedback when closing the zipper 10, increase friction between the first and second (male and female) interlocking elements 22, 36 and will modify the opening force of the zipper 10. Additionally, other combinations of cutting and crushing the zipper could be implemented, such as doing both cutting and crushing on one part of the zipper or placement of the cuts on the female profile in combination with crushed areas on the male profile.

Figure 10:
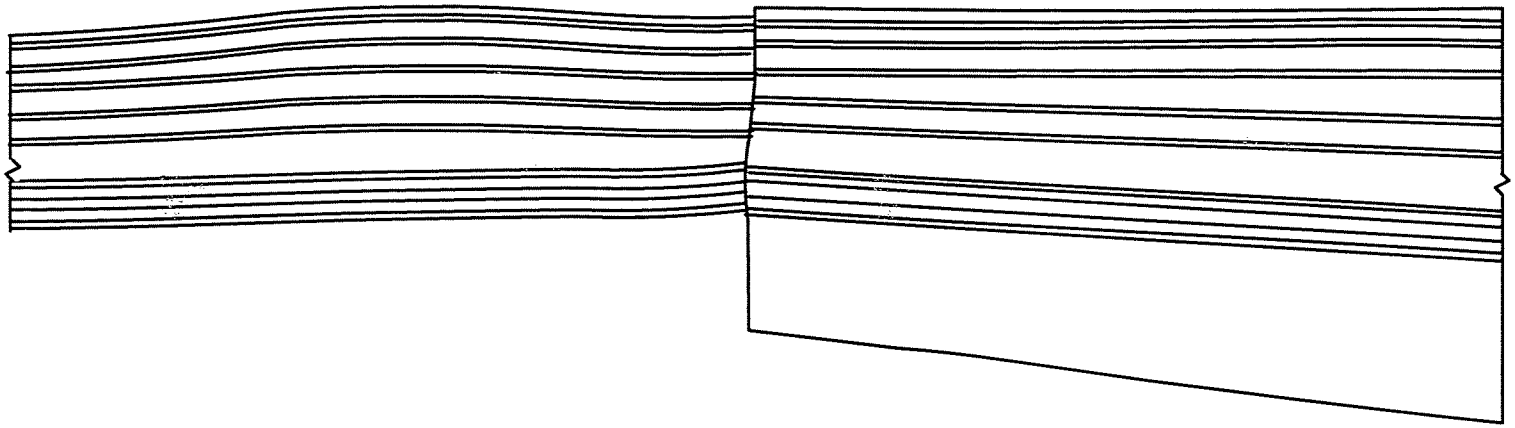
FIG. 10 is a perspective view of an embodiment of the zipper of the present disclosure.

FIG. 10 is a perspective view of the zipper 10, illustrating an embodiment without a second lower flange 34.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A reclosure for a package, bag or container, including:

a first profile including a first base and a first interlocking element, the first base having a length and the first interlocking element having a height extending perpendicularly from the length of the first base, the first interlocking element further including a plurality of cuts extending partially through the first interlocking element, the plurality of cuts being spaced sequentially along a length of the first interlocking element, the length of the first interlocking element being parallel to length of the first base; and a second profile including a second base and a second interlocking element, the second base having a length and the second interlocking element having a height extending outwardly from the length of the second base to engage, in an interlocked position, the first interlocking element, the second interlocking element further including a plurality of crushed areas, the plurality of crushed areas being perpendicular to a longitudinal axis of the second interlocking element and spaced sequentially along a length of the second interlocking element, the length of the second interlocking element being parallel to a length of the second base.

2. The reclosure of claim 1 wherein the reclosure is a zipper and the first and second profiles are respective first and second interlocking profiles.

3. The reclosure of claim 2 wherein the first interlocking element is a male element and the plurality of cuts is formed on the male element.

4. The reclosure of claim 3 wherein the second interlocking element is a female element and the plurality of crushed areas is formed on the female element.

5. The reclosure of claim 3 wherein the cuts are periodically spaced at regular intervals along a length of the male element.

6. The reclosure of claim 3 wherein the cuts are other than periodically spaced at regular intervals along a length of the male element.

7. The reclosure of claim 3 wherein the cuts have uniform depths.

8. The reclosure of claim 3 wherein the cuts have non-uniform depths.

9. The reclosure of claim 3 wherein the cuts are perpendicular to the first base.

10. The reclosure of claim 3 wherein the cuts are other than perpendicular to the first base.

11. The reclosure of claim 3 wherein the cuts are perpendicular to a longitudinal axis of the first profile.

12. The reclosure of claim 3 wherein the cuts are other than parallel to a longitudinal axis of the first profile.

13. The reclosure of claim 4 wherein the crushed areas are periodically spaced at regular intervals along a length of the female element.

14. The reclosure of claim 4 wherein the crushed areas are other than periodically spaced at regular intervals along a length of the female element.

15. The reclosure of claim 4 wherein the crushed areas are perpendicular to a longitudinal axis of the second profile.

16. The reclosure of claim 4 wherein the crushed areas are other than perpendicular to a longitudinal axis of the second profile.

17. The reclosure of claim 4 wherein the crushed and compressed areas are at uniform depths.

18. The reclosure of claim 4 wherein the crushed areas are at non-uniform depths.

19. The reclosure of claim 4 wherein crushed areas have uniform longitudinal lengths.

20. The reclosure of claim 4 wherein the crushed areas have non-uniform longitudinal lengths.

21. The reclosure of claim 2 wherein the plurality of cuts causes audible feedback to the user as the first profile is separated from the second profile.

22. The reclosure of claim 2 wherein the plurality of crushed areas causes increased tactile feedback to the user as the first profile is joined to the second profile.

23. The reclosure of claim 2 wherein the plurality of cuts are formed by a cutter.

24. The reclosure of claim 2 wherein the plurality of cuts is formed with a heated cutter.

25. The reclosure of claim 2 wherein the first and second profiles are formed of polymeric material.

* * * * *